United States Patent [19]

Schuster

[11] Patent Number: 4,712,728

[45] Date of Patent: Dec. 15, 1987

[54] CARTON WITH IMPROVED HANDLE

[75] Inventor: Richard L. Schuster, Monroe, La.

[73] Assignee: Manville Corporation, Denver, Colo.

[21] Appl. No.: 33,280

[22] Filed: Apr. 2, 1987

[51] Int. Cl.[4] ..... B65D 5/46

[52] U.S. Cl. ..... 229/52 B; 229/920

[58] Field of Search ..... 229/40, 52 B, 920; 206/427, 141

[56] References Cited

U.S. PATENT DOCUMENTS

| | | | |
|---|---|---|---|
| 3,904,036 | 9/1975 | Ferrer | 229/40 |
| 4,478,334 | 10/1984 | Graser | 229/40 |
| 4,588,084 | 5/1986 | Holley, Jr. | 229/52 B |

FOREIGN PATENT DOCUMENTS

| | | | |
|---|---|---|---|
| 740309 | 8/1966 | Canada | 229/52 B |
| 877792 | 8/1971 | Canada | 229/52 B |
| 601064 | 6/1978 | Switzerland | 229/52 B |

*Primary Examiner*—Stephen Marcus

*Assistant Examiner*—Gary E. Elkins

*Attorney, Agent, or Firm*—John D. Lister; Cornelius P. Quinn; Timothy R. Schulte

[57] ABSTRACT

A carton contains a flap on the outer top panel and a flap on the inner top panel, the free edge of the outer top panel flap overlying the inner top panel flap. When a user presses down on the outer top panel flap, it pivots out of the way to allow the user's fingers to fold the inner top panel flap under the top panel structure to provide a handle for lifting the carton. When the fingers are withdrawn, the outer top panel flap is biased upwardly by its arcuate foldable connection to close the handle opening. If the inner top panel flap is contacted by the outer top panel flap as it pivots upwardly, the outer top panel flap pushes the inner top panel flap up to a substantially closed position. Score lines extending from the ends of the foldable connections of the inner and outer top panel flaps to the corners of the carton distribute the lifting stresses to the side panels of the carton.

20 Claims, 14 Drawing Figures

CARTON WITH IMPROVED HANDLE

FIELD OF THE INVENTION

This invention relates to a carton for packaging articles, and more particularly it relates to a carton having an improved handle arrangement.

BACKGROUND OF THE INVENTION

Cartons used to package dry goods such as diapers contain an integrally formed handle to facilitate carying. One common handle design consists of two wide flaps extending substantially the length of the carton, each being foldably joined to the free end of one of the two top panels of the carton. The flaps extend upwardly at right angles to the top panels and are arranged so that their adjacent faces contact each other. Mating openings in the flaps form the handle opening through which the purchaser's hand extends when lifting and carrying the carton.

To facilitate shipping, the cartons are packed in their shipping case with the handle flaps folded down against one of the top panels. The flaps are held in this position by dabs of adhesive. Due to the tendency of the flaps to seek their upright position, they are also held in their flat condition by adhesive tape extending over the base of the uppermost flap and down over the upper portions of the side panels. This arrangement is costly due to the use of adhesive tape and because the application of hot melt adhesive to the handle flaps slows the packaging operation.

It is intended that the cartons by unpacked and shelved without activating the handles because once the handle is raised up and used it not only fails to return to its flat condition, but its resulting folded or crinkled appearance makes it appear that the carton was already opened or in some way is inferior. The carton thus becomes an unattractive choice to the purchaser.

When removing the cartons from their shipping case, however, there is often no other convenient way to lift the first few except by their handles. The cartons are packed too tightly together to permit a person's fingers to be easily squeezed between them to grip the sides of a carton and lift it out. Even after the cartons are unloaded from their shipping case they are often lifted during the shelving process by their handles. Although store personnel tend to handle the cartons in this manner more readily when unloading and stocking larger size cartons, even the smaller sizes are quite often treated this way.

It would be desirable to provide a carton handle which could be used by store personnel without giving the carton an undesirable used appearance. It would also be desirable to provide a carton with an integral handle which is stronger and not as expensive as the type currently in use.

BRIEF SUMMARY OF THE INVENTION

This invention provides a handle flap foldably connected to the inner top panel of the carton and another flap foldably connected to the outer top panel. The free edge of the outer top panel flap overlies the inner top panel flap so that when the fingers of a user press down on the outer top panel flap, both the outer top panel flap and the inner top panel flap pivot downwardly. The inner top panel flap is folded under by the user's fingers and the outer top panel flap is pivoted downwardly by the backs of the user's fingers. Means are provided to cause the outer top panel flap to be biased toward its original position so that when the user's hand is withdrawn the handle opening will be closed and the package will appear fresh and unopened. In addition, tension relief score lines are provided in the top panels, extending from the ends of the foldable connection of the flaps toward the top corners of the carton, so that when the carton is lifted by the handle the upper panel structure will bow upwardly in a gentle uniform manner as the lifting stresses are distributed outwardly from the carton handle.

Other features and aspects of the invention, as well as its various benefits, will be made clear in the more detailed description of the invention which follows.

DESCRIPTION OF THE INVENTION

Figure 1:
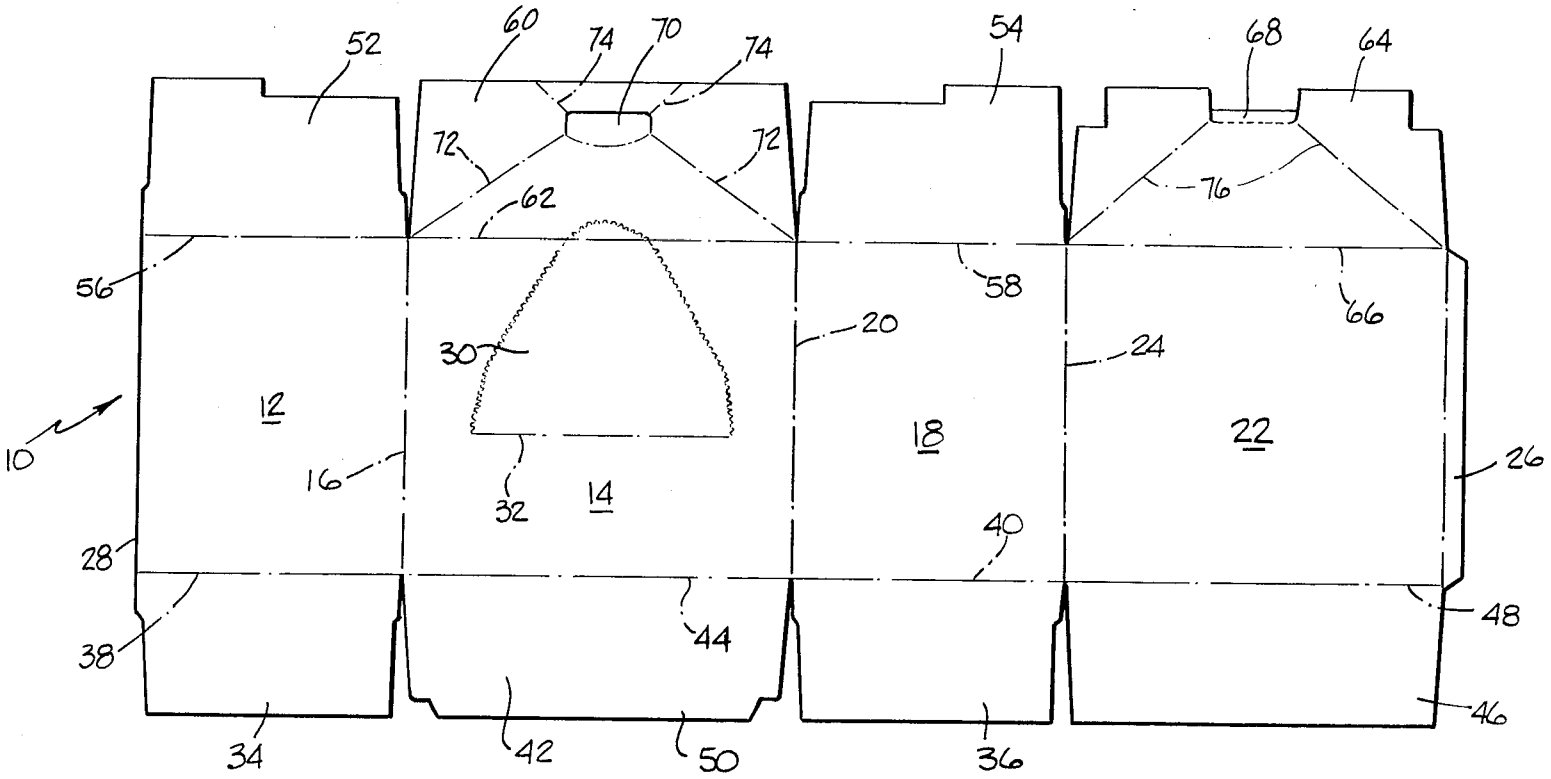
FIG. 1 is a plan view of a carton blank used to form a carton containing the handle arrangement of the present invention.

Referring to FIG. 1, a production blank 10 for forming a carton containing the handle arrangement of this invention comprises side panels 12 and 14 connected to each other along fold line 16, side panel 18 connected to panel 14 by fold line 20, and side panel 22 connected to panel 18 to fold line 24. Foldably connected to side panel 22 is glue flap 26 which, after the side panels are folded along their fold lines, is adhered to the inside surface of side panel 12 adjacent its edge 28. All of the panels intended to be the upright panels of the carton have been referred to as side panels, none of them being limited to being the front or back panels. In practice, the panels 14 and 22 preferably would be either the front or back panel because they are shown as being wider than panels 12 and 18, but this would be a matter of preference to the producer of the product packaged in the carton. Panel 14 is shown as having a tear-away closure 30 adapted to be folded downwardly about fold line 32 to allow the consumer to remove the contents of the package. While it is preferred to provide a tear-away closure in order to keep the top panel structure of the carton closed at all times and to facilitate removal of the contents, it should be understood that this feature is not essential and can be omitted without adversely affecting the performance of this invention.

Bottom dust flaps 34 and 36 are connected to side panels 12 and 18 by fold lines 38 and 40, respectively. Inner bottom panel 42, connected to panel 14 by fold line 44, is adapted to be folded up over the dust flaps after they have been folded in toward each other. Similarly, outer bottom panel 46, connected to panel 22 by fold line 48, is adapted to be folded up over the dust flaps 34 and 36 so as to overlap the inner bottom panel 42. The inner and outer bottom flaps are glued to the dust flaps, and the edge of the outer bottom panel 46 is glued to the glue strip 50 located along the edge of inner bottom panel 42 to hold the bottom panel structure in place.

In the same manner, upper dust flaps 52 and 54 are connected to side panels 12 and 18 by fold lines 56 and 58, respectively. Outer top panel 60 is connected to side panel 14 by fold line 62 and inner top panel 64 is connected to side panel 22 by fold line 66. The inner top panel 64 contains a handle flap 68 and the outer top panel 60 contains a flap 70, the specific arrangement of which is described in detail hereinafter. Also shown are score lines 72 and 74 in the outer top panel 60, and score lines 76 in the inner top panel 64, the function of which will be explained hereinafter.

Figure 2:
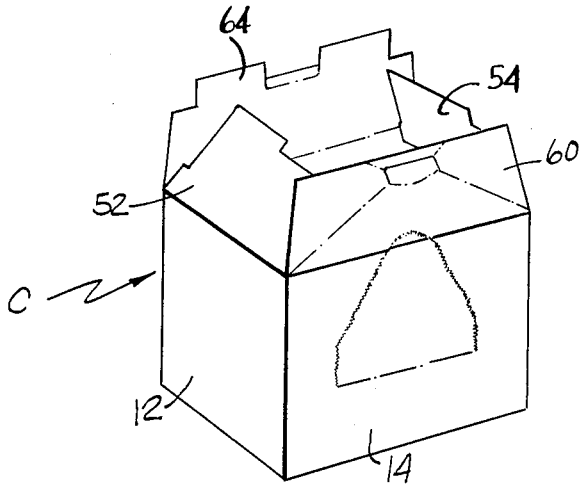
FIG. 2 is a pictorial representation of a carton whose upper panel structure is in the process of being formed.
Figure 3A:
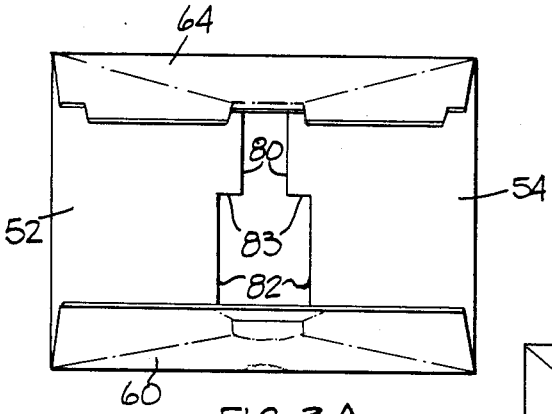
FIG. 3A is a top plan view of the carton with the dust flaps folded down but prior to the folding of the top panels.
Figure 3B:
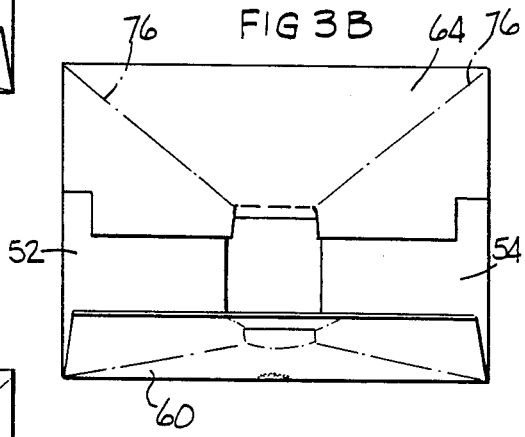
FIG. 3B is a view similar to that of FIG. 3A, but showing the inner top panel in folded condition.
Figure 3C:
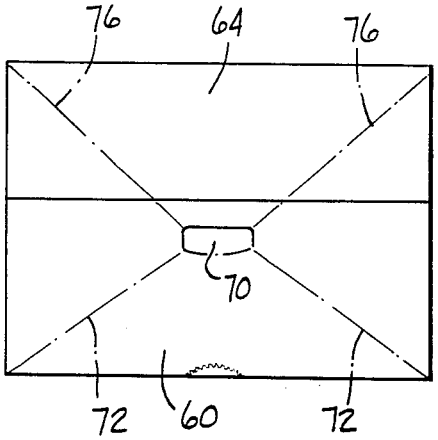
FIG. 3C is a view similar to that of FIG. 3B, but showing the outer top panel also in folded condition.
Figure 4:
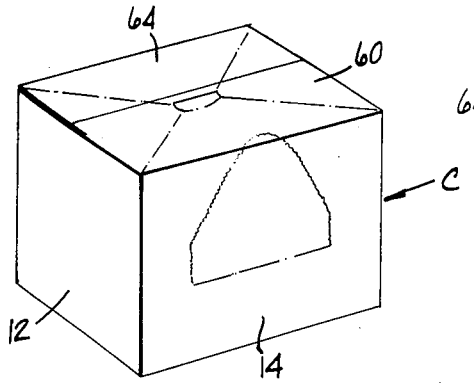
FIG. 4 is a view similar to that of FIG. 2, but showing the carton in its closed condition.

After the bottom panel structure of the carton is formed in the manner described above, but before the upper panel structure is formed, the carton C will appear as shown in FIG. 2, with the dust flaps 52 and 54, the outer top panel 60 and the inner top panel 64 being ready to be folded. To complete the formation of the carton, the dust flaps 52 and 54 are folded down, as shown in FIG. 3A. The inner top panel 64 is then folded down and glued to the dust flaps, as shown in FIG. 3B, and then the outer top panel 60 is folded down and glued to the dust flaps and to the overlapped edge portion of the inner top panel 64, as shown in FIG. 3C. The secured carton of FIG. 3C is also shown in FIG. 4, illustrating the flat upper panel structure of the carton.

As shown in FIG. 3A, the dust flaps 52 and 54 re relatively wide in the area covered by the inner top panel 64, resulting in the edges 80 of the dust flaps being relatively close together in this area. The dust flaps are relatively narrow in the area covered by the outer top panel 60, resulting in the edges 82 of the dust flaps being relatively far apart in this area. The edges 80 are connected to the edges 82 by short edges or shoulders 83, the purpose of which will be explained later.

As shown in FIG. 3C, the score lines 72 of the outer top panel 60 can be seen to extend from the handle flap 70 to the nearest corners of the carton, and the score lines 76 of the inner top panel can be seen to extend to their nearest corners of the carton.

Figure 5:
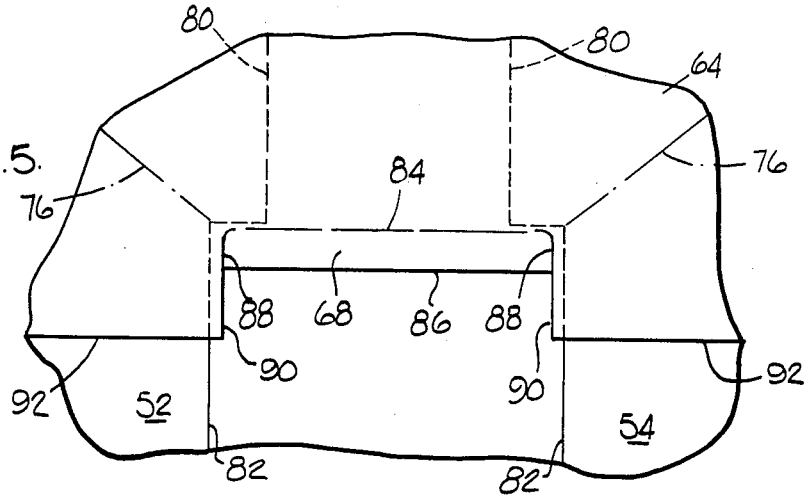
FIG. 5 is an enlarged partial plan view of the carton structure shown in FIG. 3B, with the underlying dust flaps shown in dotted lines.

Referring to FIG. 5, which is an enlarged view of the central portion of the carton configuration shown in FIG. 3B, the flap 68 is attached to the inner top panel 64 along fold line 84, which may be formed as a skip-cut line. The free edge 86 of the flap is connected to the fold line 84 by slits 88 so that the flap 68 is free to fold down about the fold line 84. The slits 88 are continuations of edges 90 which form with the free edge 92 of the inner top panel 64 the recess in which the flap 68 is located. The edges 90 and slits 88 are slightly inwardly offset from the edges 82 of the dust flaps 52 and 54 so that the dust flaps do not interfere with the ability of the flap 68 to pivot downwardly about its fold line 84. Note that the edges of the dust flaps which are covered by the overlying inner top panel 64 are shown in dotted lines. Also, the score lines 76 are shown extending toward the corners of the carton from the ends of the fold line 84.

Figure 6:
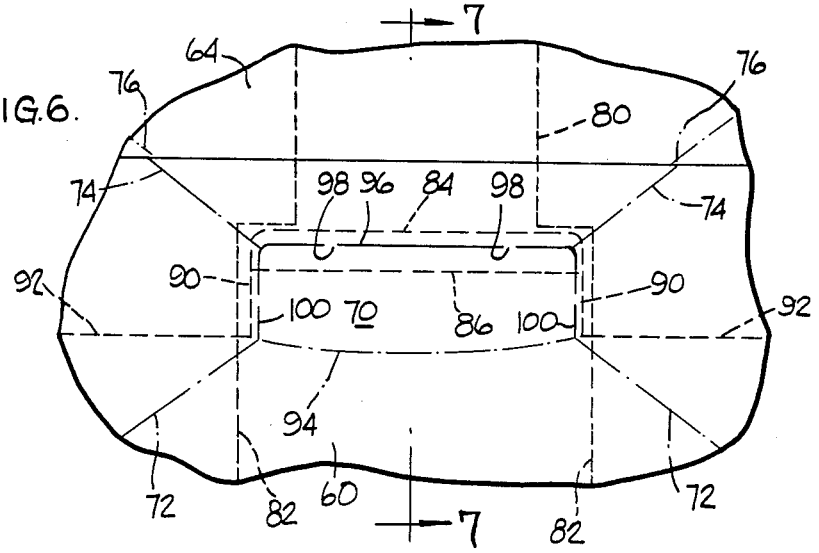
FIG. 6 is an enlarged partial plan view of the carton structure shown in FIG. 3C, with the underlying inner top panel shown in dotted lines.

Referring to FIG. 6, which is an enlarged view of the central portion of the carton configuration shown in FIG. 3C, the outer top panel 60 can be seen to overlie portions of the dust flaps and the free edge portion of the inner top panel 64. The edges 82 of the dust flaps, the edges 90 and 92 of the inner top panel 64, and the edge 86 and fold line 84 of the inner top panel flap 68, are covered by the outer top panel but are shown in dotted lines to illustrate the relationships of the elements. The outer top panel flap 70, which is spaced inwardly from the free edge of the outer top panel 60 so as to be separated from the free edge by a strip or border of the outer top panel, is connected to the outer top panel along the score line 94. The free edge 96 of the flap 70 overlies the inner top panel flap and is shown as being attached to the outer top panel by narrow segments of paperboard 98 which can be easily broken or torn when the flap is pressed down. The segments of paperboard, which hold the flap in place flush with the surface of the outer top panel prior to the handle being used, may also be provided along the transverse edges 100 which connect the free edge 96 of the flap and the score line 94, if desired. The portion of the outer top panel adjacent the transverse edges 100 makes a triple thickness of paperboard in the areas of the upper panel structure adjacent the sides of the handle opening covered by the flap 70. The free edge of the flap 70 preferably is centrally located so that it lies substantially midway between the side panels 14 and 22. With this arrangement the user's hand lifts the carton from the center of the upper panel structure, providing for a balanced load.

The score line 94 is arcuate in shape so that the width of the flap is greater midway between the transverse edges 100 than it is at the ends of the score line 94. This nonlinear score line arrangement acts to bias the flap 70 upwardly so that after being folded downwardly about the score line 94, it tends to return to its original position. It should be understood that the flap 70 is not designed to be folded under in the manner of flap 68 as would happen if the user's hand were inserted from the opposite direction. I such an event the nonlinear score line arrangement would tend to cause fibers in the paperboard adjacent the ends of the arcuate score line 94 to rupture, thereby lessening the bias and possibly preventing the flap 70 from being biased back to its original position.

Still referring to FIG. 6, the score lines 72 are shown as extending from the ends of the score line 94 toward the corners of the carton, and the score lines 74 are shown as extending away from the ends of the free edge 96. The score lines 74 are positioned so that they overlie the score lines 76 of the inner top panel 64 and in effect form a continuation thereof after the inner and outer top panels have been adhered to each other and to the dust flaps.

Figure 7A:
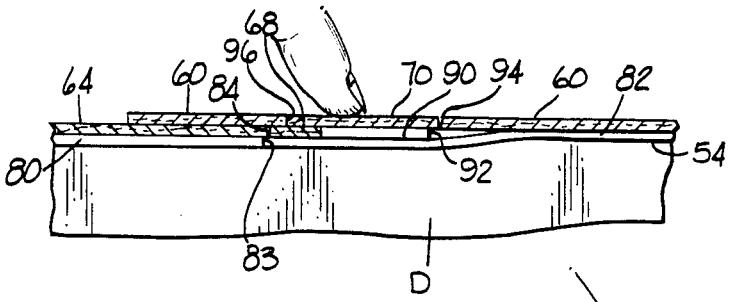
FIGS. 7A, 7B and 7C are partial enlarged sectional views taken transversely through the handle portion along line 7—7 of FIG. 6, showing the sequential positions of the handle flaps as the fingers of a user are inserted into the handle portion preparatory to lifting the carton.

Referring to FIG. 7A, the outer top panel 60 is shown with the free edge 96 of the flap 70 overlying the flap 68 of the inner top panel 64. The dust flap 54 lies directly beneath both the inner and outer top panels and, due to its flexible nature, is adhered to the lower surfaces of both panels even though the outer top panel is at a slightly higher level than the inner top panel. The shoulder 83 of the dust flap 54 is shown to be below and slightly offset from the fold line 84 of the inner top panel flap 68 to allow the flap to be folded down. The contents of the carton are indicated at D which is intended to represent diapers or other dry goods.

Figure 7B:
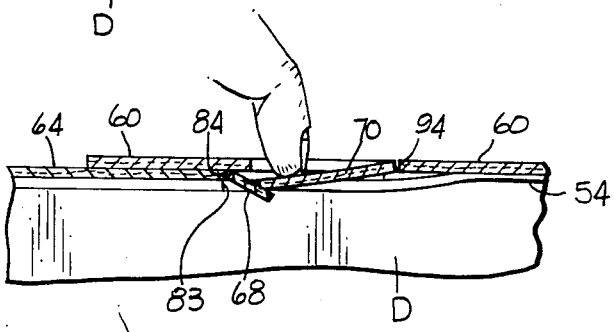

As shown in FIG. 7B, when a person wishing to lift the carton by the handle presses down on the flap 70, the narrow segments of paperboard which normally hold the flap in its flush position are torn and the flap is free to be pivoted downwardly about its score line 94. The free edge of the flap 70 in turn presses down against the inner top panel flap 68, causing it to pivot downwardly about its fold line 84.

Figure 7C:
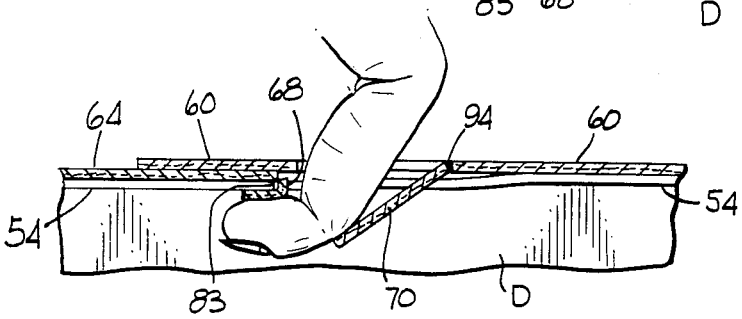

As shown in FIG. 7C, continued downward pressure by the user's fingers causes the flap 68 to be folded about the dust flap shoulders 83, allowing the fingers to grip the three-layered upper panel structure so that the carton can be lifted. As the fingers are moved down under the upper panel structure, the backs of the fingers push the flap 70, pivoting it down about its score line 94. In this position the flap 70 does not interfere with the lifting of the carton.

Figure 8:
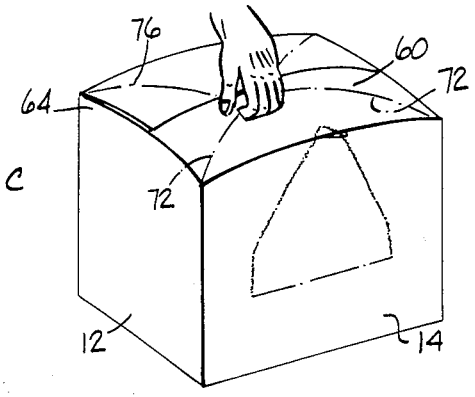
FIG. 8 is a view similar to that of FIG. 4, but showing the carton as it is being lifted.

The carton is shown while being lifted in FIG. 8. Since the upper panel structure is flexible, it is raised up from the flat condition shown in FIG. 4. To alleviate the tendency of the lifting stresses to tear the upper panel structure around the handle opening, the score lines 72, 74 and 76 make the structure more rigid and serve to distribute the stresses toward the corners of the carton. The upper panel structure is thus raised upwardly in a more gengle bowing action during the lifting process. Preferably, the score lines 72, 74 and 76 extend all the way to the corners of the top panel of the carton for the most effective distribution of stress, but it should be understood that the score lines can terminate short of the corners and still function to distribute the lifting stresses in a manner which alleviates the stresses at the handle opening and allows the top panel to gently bow upwardly when lifted.

Figure 9:
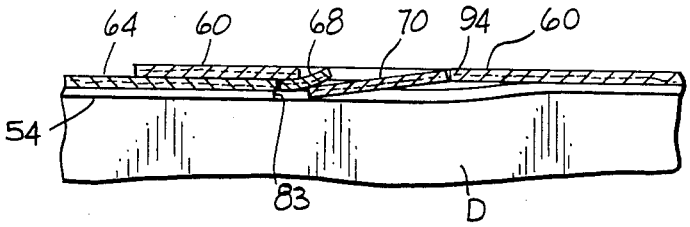
FIG. 9 is a view similar to those of FIGS. 7A, 7B and 7C, but showing the carton handle after the fingers of a user have been withdrawn.

When the carton is set down and the hand removed from the handle opening, the user's fingers will often drag the inner top panel flap 68 back to its extended position. Since this would happen before the backs of the figers are completely disengaged from the outer top panel flap 70, the outer top panel flap would be biased back toward its original position by the arch-shaped fold line 94 only after the inner top panel flap has been moved back. This results in the flap orientation illustrated in FIG. 9, wherein the inner top panel flap 68 is shown after being pushed slightly beyond its original position by the force of the spring-like return of the outer top panel flap 70. In this relationship the combination of the two flaps covering the handle opening, with the flaps lying substantially flush with the top of the carton, presents a fresh, new appearance which does not suggest that the carton has already been lifted by the handle. A person subsequently wishing to lift the carton by the handle need only insert the fingers as in the manner previously described to again push the flap 70 down and bend the flap 68 back under the shoulders 83.

Figure 10:
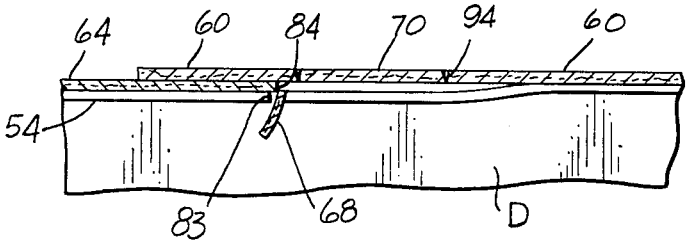
FIG. 10 is a view similar to that of FIG. 9, but showing the carton handle with the inner top panel flap in a different position after the fingers of a user have been withdrawn.

A somewhat different flap relationship is illustrated in FIG. 10, wherein the inner top panel flap 68 has not returned to its original position. This could happen if the user's fingers do not remain engaged with the flap 68 when they are withdrawn from the handle opening. In such a case the outer top panel flap 70 is biased by its arch-shaped fold line into the substantially closed position shown, and the inner top panel flap 68 remains in the interior of the carton. As in the arrangement of FIG. 9, the handle appears to have been unused due to the substantially flat condition of the flap 70. The carton can again be lifted in a similar manner to that previously described by pushing down on the flap 70 to move it out of the way, and then curling the fingers back around the flap 68 and under the dust flap shoulders 83.

When the contents of the carton are tightly packed diapers or other compressible items, the outer top panel flap may be assisted in its return toward its original position by the spring-back of the items themselves, although it should be understood that this phenomenon is not essential to the return movement of the flap.

It should now be clear that the present invention provides an improved carton handle that allows the carton to be lifted by its handle without disrupting its fresh unused appearance. In addition, the carton blank requires less paperboard than the current design, and the packaging process is faster due to the elimination of current extra gluing and taping steps. Further, because the handle portion engaged by the user's hand includes three layers of paperboard, the handle is stronger than that currently used.

It should also be understood that the term "score line" as used herein in connection with the outer top panel flap score line and the tension relief score lines in the inner and outer top panels, refers to a rupturing of the surface of the paperboard sheet, resulting in a depression on one side of the sheet and a welt on the other. It does not refer to a line which has been partially slit, which would weaken any folding action taking place along the score line.

It should be obvious that although a preferred embodiment of the invention has been described, changes to certain specific details of the preferred embodiment can be made without departing from the spirit and scope of the invention.

What is claimed is:

1. In a paperboard carton, an upper panel structure comprising:

an inner top panel;

an outer top panel overlapping a portion of the inner top panel;

the inner top panel containing a flap having an outer surface and an interior surface, and also having a free edge and an opposite edge foldably connected to the inner top panel in the overlapped portion thereof to form a foldable connection;

the outer top panel containing a flap covering a handle opening, the outer top panel flap having a free edge and an opposite edge foldably connected to the outer top panel to form a foldable connection, the foldable connections of the inner and outer top panel flaps being farther apart than the free edges of the flaps;

the free edge of the outer top panel flap overlying the outer surface of the inner top panel flap so that when fingers of a user press down on the outer top panel flap, the free edge of the outer top panel flap pivots downwardly about the foldable connection of the outer top panel flap and the inner top panel flap pivots downwardly about the foldable connection of the inner top panel flap, the inner top panel flap adapted to be folded under by the fingers and the outer top panel flap adapted to be pivoted downwardly by the backs of the fingers; and means causing the outer top panel flap to pivot upwardly upon removal of the fingers of a user.

2. A paperboard carton according to claim 1, wherein the outer top panel flap engages the interior surface of the inner top panel flap when the fingers of a user have been withdrawn and the inner top panel flap has returned to its approximately original position, the outer top panel flap biasing the inner top panel flap upwardly toward its closed position.

3. A paperboard carton according to claim 1, wherein the outer top panel flap returns to its approximately original position when the fingers of a user have been withdrawn and the inner top flap has not returned to its original position.

4. A paperboard carton according to claim 1, wherein the means for causing the outer top panel flap to pivot upwardly upon removal of the fingers of a user comprises a nonlinear foldable connection between the upper top panel flap and the upper top panel.

5. A paperboard carton according to claim 4, wherein the nonlinear foldable connection is arcuate, the distance from the ends of the arcuate foldable connection to the free edge of the outer top panel flap being less than the distance from intermediate portions of the arcuate foldable connection to the free edge of the outer top panel flap.

6. A paperboard carton according to claim 1, wherein the upper panel structure further comprises dust flaps lying beneath the inner and outer top panels.

7. A paperboard carton according to claim 6, wherein the dust flaps have ends facing each other, the ends of the dust flaps being spaced from each other in the vicinity of the inner top panel flap a distance greater than the length of the inner top panel flap to allow the inner top panel flap to be pivoted downwardly therebetween.

8. A paperboard carton according to claim 7, wherein the dust flaps further contain edges extending substantially parallel to and adjacent the foldable connection of the inner top panel flap, whereby the inner top panel flap can be folded underneath said edges by the fingers of a user.

9. A paperboard carton according to claim 1, wherein the inner top panel has a free edge and wherein the inner top panel flap is recessed from the free edge of the inner top panel.

10. A paperboard carton according to claim 1, wherein the outer top panel has a free edge and wherein the outer top panel flap is spaced from the free edge of the outer top panel.

11. A paperboard carton according to claim 10, wherein a strip of paperboard extends between the free edge of the outer top panel flap and the free edge of the outer top panel.

12. A paperboard carton according to claim 1, wherein the foldable connection of the inner top panel flap has two ends between which the foldable connection of the inner top panel flap extends, and the foldable connection of the outer top panel flap has two ends between which the foldable connection of the outer top panel flap extends, and wherein the inner top panel is connected to the carton along a fold line extending between two corners of the carton and the outer top panel is connected to the carton along a fold line extending between two opposite corners of the carton, the inner top panel containing a score line extending from each end of the foldable connection of the inner top panel flap to the nearest corners of the carton, and the outer top panel flap containing a score line extending from each end of the foldable connection of the outer top panel flap to the nearest corners of the carton, whereby when a user lifts the carton, the upper panel structure bows smoothly upwardly, the score lines assisting to distribute the lifting stresses to the corners of the carton.

13. A paperboard carton according to claim 12, wherein the outer top panel has a free edge, wherein the free edge of the outer top panel flap terminates at two ends thereof, and wherein a strip of paperboard extends between the free edge of the outer top panel flap and the free edge of the outer top panel, the strip containing score lines extending from the ends of the free edge of the outer top panel flap so as to form a continuation of the score lines in the underlying inner top panel.

14. A paperboard carton according to claim 1, wherein the foldable connection of the inner top panel flap is substantially centrally located in the upper panel structure.

15. In a paperboard carton, an upper panel structure comprising:

an inner top panel;

an outer top panel overlapping a portion of the inner top panel;

the inner top panel containing a flap having a free edge and an opposite edge foldably connected to the inner top panel in the overlapped portion thereof to form a foldable connection;

the outer top panel containing a flap covering a handle opening, the flap having a free edge and an opposite edge foldably connected to the outer top panel to form a foldable connection, the distance between the foldable connections of the inner and outer top panel flaps being greater than the distance between the free edges of the flaps;

the free edge of the outer top panel flap overlying the inner top panel flap;

the inner top panel being connected to the carton along a fold line extending between two corners of the carton;

the outer top panel being connected to the carton along a fold line extending between two opposite corners of the carton;

score lines extending from the foldable connection of the inner top panel flap toward the nearest corners of the carton; and score lines extending from the foldable connection of the outer top panel flap toward the nearest corners of the carton, whereby when a user lifts the carton, the upper panel structure bows smoothly upwardly, the score lines assisting to distribute the lifting stresses toward the corners of the carton.

16. A paperboard carton according to claim 15, wherein the outer top panel has a free edge and wherein a strip of paperboard extends between the free edge of the outer top panel flap and the free edge of the outer top panel, the strip containing score lines forming a continuation of the score lines in the underlying inner top panel.

17. A paperboard carton according to claim 16, wherein the foldable connection of the inner top panel flap is substantially centrally located in the upper panel structure.

18. A paperboard carton according to claim 15, wherein the outer top panel flap is connected to the outer top panel by a nonlinear foldable connection which biases the outer top panel flap in an upward direction.

19. A paperboard carton according to claim 18, wherein the nonlinear foldable connection has two ends between which the foldable connection extends and wherein the nonlinear foldable connection is arcuate, the distance from the ends of the arcuate foldable connection to the free edge of the outer top panel flap being less than the distance from intermediate portions of the arcuate foldable connection to the free edge of the outer top panel flap.

20. In a paperboard carton, an upper panel structure comprising:

an inner top panel;

an outer top panel overlapping a portion of the inner top panel;

the outer top panel containing a flap covering a handle opening, the flap having a free edge and an opposite edge foldably connected to the outer top panel;

the free edge of the flap being located generally centrally of the upper panel structure;

the inner top panel having an edge beneath and adjacent to the free edge of the flap, so that when fingers of a user press down on the flap the free edge of the flap pivots downwardly about the foldable connection of the flap to allow the fingers to grip said inner top panel edge; and means causing the outer top panel flap to pivot upwardly upon removal of the fingers.

* * * * *